United States Patent [19]

Ahlers

[11] Patent Number: 4,509,565

[45] Date of Patent: Apr. 9, 1985

[54] FILLING ELEMENT FOR SINGLE-CHAMBER AND MULTI-CHAMBER COUNTERPRESSURE FILLING MACHINES

[75] Inventor: Egon Ahlers, Neu-Bamberg, Fed. Rep. of Germany

[73] Assignee: Seitz Enzinger Noll Maschinenbau AG, Bad Kreuznach, Fed. Rep. of Germany

[21] Appl. No.: 434,257

[22] Filed: Oct. 14, 1982

[51] Int. Cl.[3] ..... B67C 3/06

[52] U.S. Cl. ..... 141/39; 141/198; 141/286; 141/302

[58] Field of Search ..... 141/1-12, 141/37-70, 192-229, 285-310, DIG. 1, 392; 307/308, 309; 310/11, 12; 318/445

[56] References Cited

U.S. PATENT DOCUMENTS 4,103,721 8/1978 Noguchi ..... 141/39

4,146,068 3/1979 Jordan ..... 141/39

4,381,808 5/1983 Ahlers ..... 141/39

*Primary Examiner*—Houston S. Bell, Jr.

*Attorney, Agent, or Firm*—Becker & Becker, Inc.

[57] ABSTRACT

A filling element for single-chamber and multi-chamber counterpressure filling machines. The filling element includes a controlled pressurized gas valve arrangement, a liquid flow valve which is closed by an actuating device, an electrical switching member comprising a rod-shaped probe formed over its entire length of electrically conducting material for generating a closure-control signal for the actuating device of the liquid flow valve, and a filling element body, which is made of electrically insulating material from that end of the liquid guidance conduit closest to the container or bottle as far as to at least beyond an electrical connection for the switching member, and which is provided with the holder or mounting for the switching member, which can be fixed therein and can make contact engagement with the electrical connection.

7 Claims, 4 Drawing Figures

FILLING ELEMENT FOR SINGLE-CHAMBER AND MULTI-CHAMBER COUNTERPRESSURE FILLING MACHINES

The present invention relates to a filling element for single-chamber and multi-chamber counterpressure filling machines. The filling element includes: a controlled pressurized gas valve arrangement for producing a gas pressure in a pressed-on bottle or container which is to be filled before liquid flows into it; a liquid flow valve which is closed by means of an actuating device and is provided in the filling element housing; and an electrical switching member or control mechanism for generating a closure-control signal for assumption of the closing position of the valve actuating device upon contact with the liquid rising in the bottle or container, whereby the switching member, which is connected with an electrical connection, is fixed in a holder or mounting located below the liquid flow valve in the filling element body, and is electrically insulated with respect to a liquid guidance conduit having a conductive element; the holder or mounting shields the switching member from contact with liquid in the liquid guidance conduit.

With a filling element of this general type as disclosed by German Offenlegungsschrift No. 16 07 996, the electrical switching member for generating the closure control signal for the actuating device of the liquid flow valve is in the form of an attachment fastened to a pressurizing gas and return gas tube which extends into the bottle or container to be filled; this tube can be inserted and held in a holder or mounting arranged below the liquid flow valve in the filling element housing. With this construction, it is particularly difficult to guide or convey the electrical connection line to the switching member through the wall of the filling element housing to the holder or mounting, and through the mounting to the switching member at the pressurized gas and return gas tube. Aside from the difficult running of wires and the costly insulation thereof, special problems are encountered with this known apparatus in connection with the electrical insulation of the holder or mounting and of the switching member with respect to the liquid guidance conduit in the filling element housing. As a result, the known filling element requires special care during disassembly and reassembly of the filling element housing of the holder or mounting, and of the pressurized gas and return gas tube which is equipped with the switching member, so that the functional certainty is guaranteed.

It is therefore an object of the present invention to provide a filling element of the aforementioned general type equipped with a switching member, and to considerably improve the same in such a way that the insulation problems (which affect the functional capability) for the holder or mounting and the switching member with respect to the liquid guidance conduit in the filling element housing are eliminated during the assembly or disassembly thereof, and a satisfactory electrical connection arrangement is assured for the switching member.

This object, and other objects and advantages of the present invention, will appear more clearly from the following specification in connection with the accompanying drawings, in which.

Figure 1:
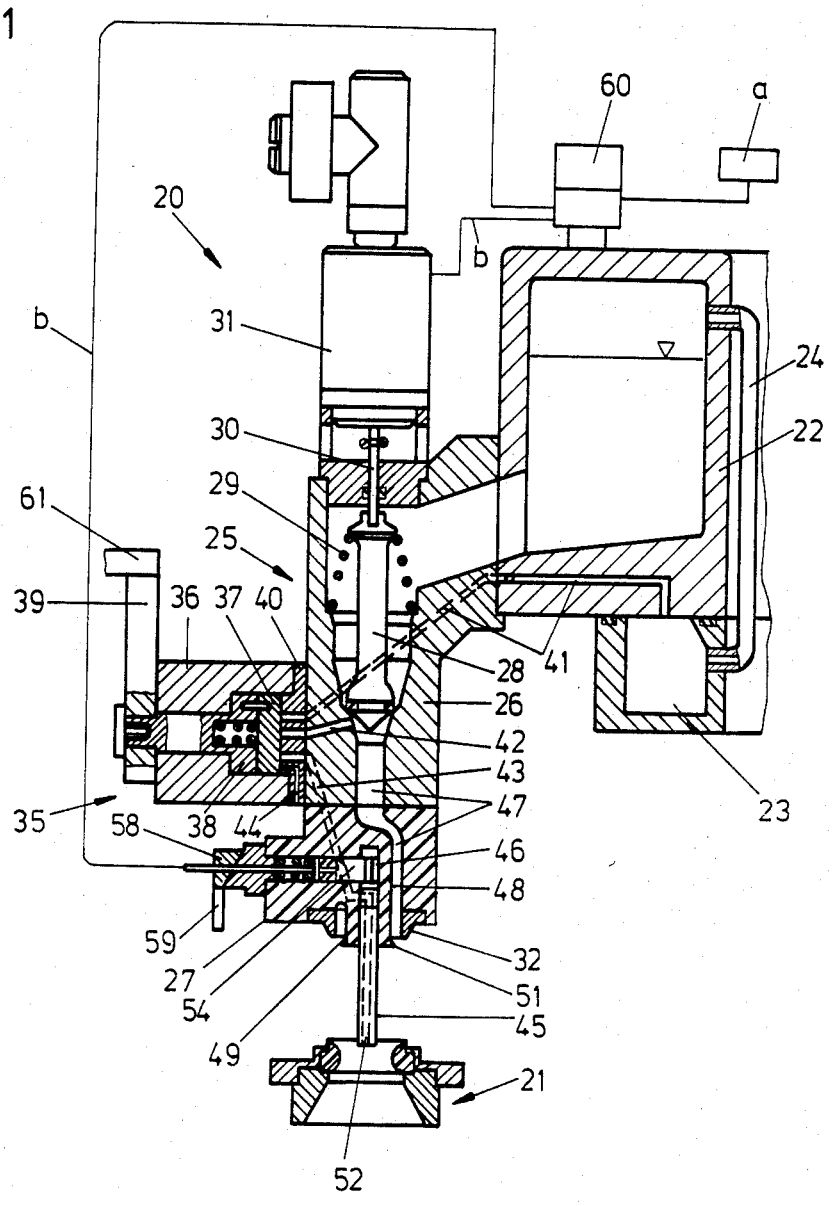
FIG. 1 is an axial section of one invention embodiment of a filling element for a single-chamber construction.

The filling element of the present invention is characterized primarily in that the filling element body is made of electrically insulating material from that end of the liquid guidance conduit which is closest to the bottle or container, as far as to at least beyond the electrical connection of the switching member; the holder or mounting for the switching member is provided in this part of the filling element body; and the switching member comprises a rod-shaped probe formed of an electrically conducting material over its entire length; the probe can be fixed in the holder or mounting, and can be in contact with the electrical connection.

Aside from a technically simple construction of the filling element, pursuant to the present invention, the holder or mounting necessary for the switching member, and the electrical connection arrangement, are completely insulated with respect to the liquid conveyed in the filling element housing; a simple and economical rod-shaped probe can be utilized for the switching member which is to be installed and fixed in the holder or mounting; the probe is made of electrically conducting material over its entire length. It is advantageous that such probes can be quickly and easily exchanged during changing of the types of bottles, and the renewed filling level adjustment connected therewith.

According to further specific features of the present invention, that part of the filling element body which extends from the end of the liquid guidance conduit closest to the container or bottle as far as to at least beyond the electrical connection of the switching member or control mechanism, and is made of an elctrically insulating material, may be constructed as a lower or base portion which, along with a filling element housing of rustproof or stainless steel, forms the filling element body. The lower or base portion of the filling element body may be releasably connected with the filling element housing. A sealing plate for a container or bottle centering device may be rigidly installed at that end of the filling element body, or the lower or base portion, which is closest to the container or bottle.

The switching member or control mechanism may be able to be fixed in the holder or mounting by a contact pin which can be axially moved in the holder or mounting and in the lower or base portion; when one end face of the contact pin is pressed in electrical contact against the switching member or control mechanism, the electrical connection is formed, and simultaneously that one of the contact pin provided with the one end face can fix the switching member by engaging below the shoulder of an annular groove of the switching member, and can be removed from the region of the annular groove. The switching member or control mechanism, below the contact connection with the contact pin in the holder or mounting, can be sealed off by sealing means, such as a sealing ring. It is also possible to have the contact pin axially movable in the holder or mounting and in the lower or base portion of the filling element body in a horizontal plane below the pressurized gas valve arrangement.

Referring now to the drawings in detail, the illustrated example shows a filling element 20 for single-chamber counterpressure bottle filling machines. Such filling elements of circulating filling machines (not illustrated in greater detail) have a container centering device 21 which can be raised and lowered, and are attached to an annular liquid chamber 22, the underside of which supports an annular channel 23 for pressurized gas and return gas; this channel 23 is connected via a connecting tube 24 to the upper part of the liquid chamber 22, which is filled with pressurized gas that is at an overpressure. The filling element 20 has a filling element body 25 with a filling element housing 26 and a lower or base portion 27 of electrically insulating synthetic material. A vertical liquid flow valve 28 which is biased by an opening spring 29 is located in the interior of the filling element housing 26. An electromagnetic actuating device 31 is effective by means of a push rod 30 upon the valve body of the liquid flow valve 28, which valve body is supported on a valve seat. When the actuating device 31 is made operative, it presses the valve body, counter to the opening spring 29, onto the valve seat, thereby establishing the closed position of the liquid flow valve 28.

A pressurized gas valve arrangement 35 is attached on the side of the filling element housing 26; the pressurized gas valve arrangement 35 includes a housing 36 in which a valve disc 37, which is provided with a connecting channel not illustrated in greater detail, is arranged in the form of a control disc which can be rotated by means of a carrier or support 38. The free end of the support 38 projects out of the housing 36 and has an actuating lever 39 which during machine rotation cooperates with control elements 61, for example cams, attached to the frame of the filling machine in spaced-apart relationship and in different planes or levels, in order to pivot the valve disc 37 into the respectively desired operating position. A spring presses the valve disc 37 in a gas-tight manner against a base plate 40, in that surface of which facing the valve disc 37 there opens the pressurized gas and return gas conduit 41 which comes from the annular channel 23 and is conveyed through the lower leg of the annular liquid chamber 22 and through the filling element housing 26. Furthermore, there open at that surface of the base plate 40 which faces the valve disc 37 an equalizing conduit 42, which below the liquid flow valve 28 leads into the liquid guidance conduit of the lower part 27, as well as a pressurized gas and return gas conduit 43, and a relief or by-pass conduit 44 which is conducted outwardly in the base plate 40.

Figure 2:
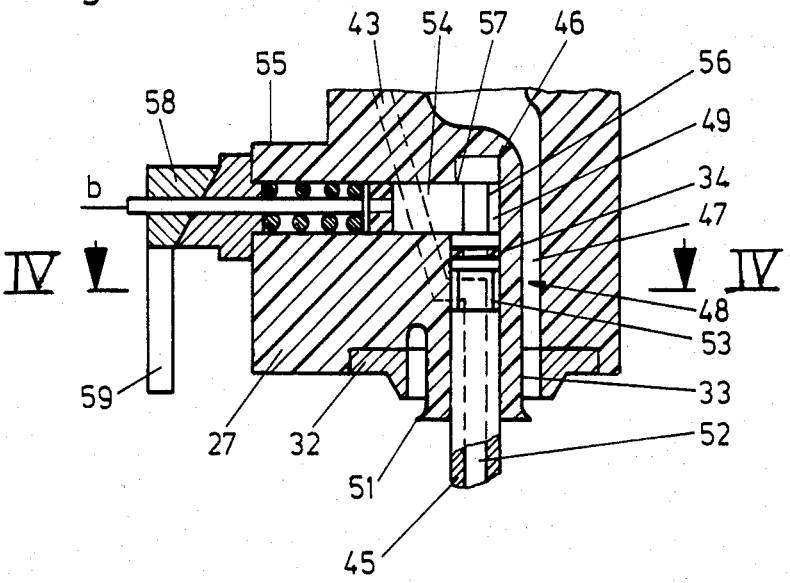
FIG. 2 is an axial section of the bottom or base of the housing of the filling element with a fixed probe which is electrically connected.
Figure 4:
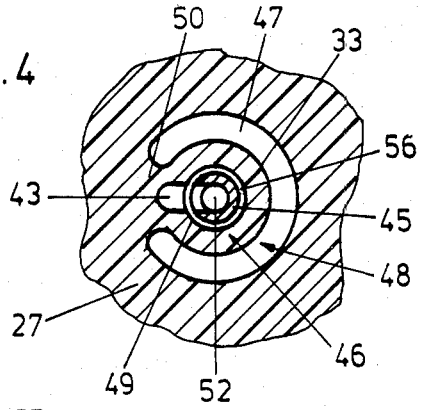
FIG. 4 shows a detailed cross sectional view of the housing bottom or base of the housing taken along line IV-IV in FIG. 2.
Figure 3:
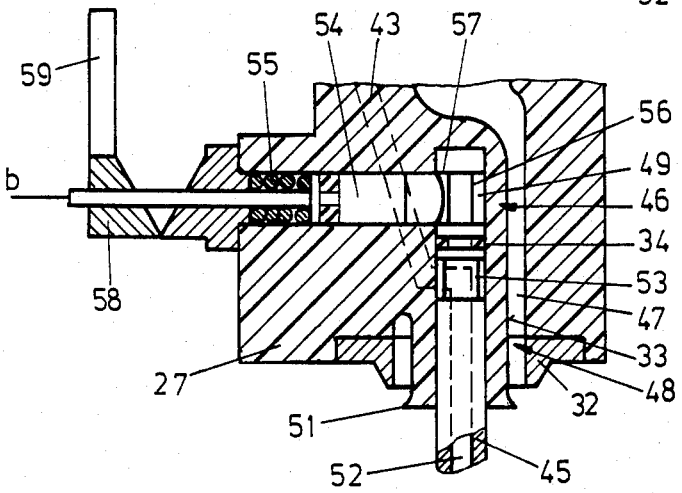
FIG. 3 shows the bottom or base of the housing of the filling element as in FIG. 2, though with released and electrically disconnected probe.

Furthermore, to control the liquid flow valve 28, a switching member or control mechanism 45 is provided which is introduced from the underside of the lower or base portion 27 into a holder or mounting 46 in said lower portion 27, and is fixed therein. This holder or mounting 46, as shown in more detail in FIGS. 2 through 4, is provided in a widened portion 33 of a continuation 48 of the lower or base portion 27, which continuation 48 projects into the liquid guidance conduit 47. The holder or mounting 46 has a cylindrical blind hole 49 which extends in the longitudinal axis of the filling element. The pressurized gas and return gas conduit 43 is connected to this blind hole 49 by means of a web 50 which supports the widened portion 33 of the continuation 48 (FIG. 3). Furthermore, a sealing plate 32 for the container centering device 21 is inserted on the underside of the lower or base portion 27. A deflecting shield 51, which is concentric to the blind hole 49, is provided at the end of the widened portion 33 which projects beyond the sealing plate 32. The deflecting shield 51 forms that end of the liquid guidance conduit 47 which faces the container, and deflects the liquid flowing downwardly through the conduit 47 out of the filling element 20 away from the switching member or control mechanism 45 into a bottle which at any given time is to be filled, and expediently against the inner wall of the bottle. The switching member or control mechanism 45 is made of electrically conductive material over its entire length, and is provided with a central bore 52 for conveying pressurized gas and return gas. This bore 52 extends from that end of the switching member or control mechanism 45 which faces the container or bottle, as far as to the base or bottom of a narrowed portion 53 which is arranged opposite to the opening of the pressurized gas and return gas conduit 43 into the blind hole 49.

The electrical connection of the switch member or control mechanism 45, which is expediently embodied as a rod-shaped probe in the holder or mounting 46, is effected by a contact pin 54, which is installed horizontally in the electrically insulating lower part 27 below the pressurized gas valve arrangement 35 and is guided through the web 50 into the holder or mounting 46. The contact pin 54 is axially movable, and the end face of the inner end of the pin is pressed by a spring 55 against the base or bottom of an annular groove 56 which is located at the upper end of the switching member or control mechanism 45. At the same time, the end of the pin engages below the shoulder 57 of the annular groove 56, thereby fixing the switching member or control mechanism 45 in that position thereof where it is inserted in the holder or mounting 46. In order to lift the contact pin 54 from the switching member or control mechanism 45 and to retract or withdraw it from the region of the annular groove 56 or shoulder 57, a rotating wedge or key 58 having a pivot lever 59 is installed on the outwardly located end of the contact pin 54; the pivot lever 59 runs or engages against a counterrotating wedge or key installed on the lower or base portion 27. A sealing ring 34, which is received in an annular recess of the switching member or control mechanism 45 above the narrowed portion 53, separates the contact pin 54 from the narrowed portion 53.

With the filling element 20 according to the above described construction, the filling element body 25, formed by the filling element housing 26 and the lower or base portion 27, is made entirely of electrically insulating material, while with a conventional construction of the filling element housing 26 of rustproof or stainless steel, only the lower or base portion 27 is made of electrically insulating material, for example polyphenyleneoxide, polyamide resins, or polytetrafluoroethylene, and extends from that end of the liquid guidance conduit 47 which is closest to the container or bottle at least beyond the electrical connection of the switching member or control mechanism 45 via the contact pin 54 and is connected releaseably and pressure-tight with the filling element housing 26. In either case, the switching member or control mechanism 45 and the electromagnetic actuating device 31 of the liquid flow valve 28 are connected with one another by a circuit through the interposition of an electrical control device 60. This circuit, which can be established by liquid contact, is formed (starting from the switching member or control mechanism 45 and the contact pin 54 which is connected therewith) by: the line "6", which is connected to the contact pin 54 and, through the interposition of the control device 60 and the power supply or current source "a" connected thereto, leads to the electromagnetic actuating device 31; the liquid chamber 22; and the housing 26 of the filling element body 25. The control device 60, which is connected to the source of current "a" for supplying the electrical circuit, has electrical switch means for controlling the actuating device 31 for the liquid flow valve 28, and, as indicated, can be arranged at the top of or in the open space of the inner periphery of the annular liquid chamber 22 (see FIG. 1).

As shown in FIG. 3, the electrical connection between the contact pin 54 and the switching member 45 can be interrupted or broken by pivoting the pivot lever 59. The contact pin 54 is retracted against the effect of the spring 55 out of the region of the shoulder 57 of the annular groove 56 as a result of the hereby effected movement or running of the rotating wedge 58 upon the counter-rotating wedge. The switching member 45 can thus be withdrawn downwardly from the holder or mounting 46 in the lower or base portion 27 of the filling element housing 26. Stated in another way, the contact pin 54 can only move into its operating position below the shoulder 57 under the influence of the spring 55, and thereby establish contact with the switching member 45, when the annular groove 36 of the switching member 45 is properly and completely inserted into the holder or mounting 46 in the lower or base portion 27 of the filling element housing 26.

The filling element 20 has the starting position illustrated in FIG. 1 prior to the beginning of the filling procedure, of which the most essential phases are subsequently described for further explanation of the present invention. In this connection, the electromagnetic actuating device 31, which has been made operative, holds the liquid flow valve 28 closed counter to the opening spring 29. Furthermore, the connection of the conduit 41, 42, 43, and 44 is interrupted by the valve disc 37, which is in a neutral position. After conventionally pressing the bottle onto the filling element (whereby the container centering device 21 reaches the sealing plate 32 of the circulating or rotating filling element 20, and the switching member 45 moves into the interior of the bottle), there occurs, after pivoting the valve disc 37 as a result of the actuating lever 39 contacting a control element 61 of the machine frame, the pressurizing of the bottle from the annular channel 23 via the conduits 41, 43, which are connected with one another after this pivoting movement by the connection conduit of the valve disc 37, and via the central bore 52 of the switching member 45. Upon pressure equalization between the further pressed on bottle and the liquid chamber 22, and shortly before the electromagnetic actuating device 31 is made inoperative, the opening spring 29 moves the liquid flow valve 28 upwardly, so that the liquid flows into the bottle via the opened liquid guidance conduit 47. While maintaining the pivoted position of the valve disc 37, the return gas is removed from the bottle via the central bore 52 and the connected conduits 41, 43, and is returned to the annular channel 23 as well as to the liquid chamber 22.

If the liquid reaches the lower end of the switching member 45, the length of which is adapted to the filling level in the bottle, then the liquid contact establishes the previously described electrical circuit. The electromagnetic actuating device 31 is thereby made operative, returning the liquid flow valve 28 to the closed position counter to the opening spring 29. The accompanying pressure equalization, and the subsequent pressure relief, occur after each pivot movement of the valve disc 37, whereby the connection conduit thereof connects the conduit 43, with the equalizing conduit 42 for pressure equalization, and connects the conduit 42 with the relief conduit 44 for release. After this filling procedure, the valve disc 37 is returned or pivoted back into the neutral starting position, and the bottle filled during one cycle of the filling element 20 is withdrawn from the filling element 20 and is transported in a conventional manner out of the filling machine.

The present invention is, of course, in no way restricted to the specific disclosure of the specification and drawings, but also encompasses any modifications within the scope of the appended claims.

What I claim is:

1. A filling element for single-chamber and multi-chamber counterpressure filling machines, said filling element comprising:

a filling element body which is provided with a liquid guidance conduit;

a controlled, pressurized gas valve arrangement associated with said filling element body for producing a gas pressure in a pressed-on container which is to be filled prior to liquid flowing therein;

a liquid flow valve provided in said filling element body for opening and closing said liquid guidance conduit;

an actuating device for effecting opening and closing of said liquid flow valve, and hence of said liquid guidance conduit;

an electrical switching member for generating a closure-control signal, upon contact of said member with liquid rising in a pressed-on container, for having said actuating device assume a closing position; said switching member being electrically insulated relative to said liquid guidance conduit, and being a rod-shaped probe of electrically conductive material over its entire length;

an electrical connection which is electrically connectible with said actuating device and with said probe; said filling element body being made of electrically insulating material from that end of said liquid guidance conduit thereof which would be closest to a pressed-on container, to at least beyond said electrical connection; and a holder located below said liquid flow valve in that part of said filling element body made of electrically insulating material for fixing the position of said probe and for shielding said probe from contact with liquid in said liquid guidance conduit.

2. A filling element according to claim 1, in which said filling element body comprises a filling element housing of stainless steel, and a lower part which forms that part of said filling element body made of electrically insulating material.

3. A filling element according to claim 2, in which said lower part of said filling element body is releasably connected with said filling element housing.

4. A filling element according to claim 3, which includes a container centering device, and a sealing plate for said centering device, said sealing plate being rigidly installed on that end of said lower part of said filling element body which would be closed to a pressed-on container.

5. A filling element according to claim 2, in which said electrical connection includes a contact pin which is axially movable in said holder and in said lower part of said filling element body, with the end face of one end of said contact pin being adapted to be pressed against said probe to effect said electrical connection therewith; and in which said probe is provide with an annular groove which forms a shoulder on said probe, with said one end of said contact pin being adapted to extend below said shoulder, while effecting said electrical connection, to furthermore effect fixation of said probe in said holder; said contact pin also being adapted to be withdrawn from the region of said annular groove.

6. A filling element according to claim 5, which includes sealing means for sealing off said probe in said holder below said contact connection with said contact pin.

7. A filling element according to claim 5, in which said contact pin is axially movable in said holder and in said lower part of said filling element body in a horizontal plane located below said pressurized gas valve arrangement.

* * * * *